US006685574B2

(12) United States Patent
Hall

(10) Patent No.: US 6,685,574 B2
(45) Date of Patent: Feb. 3, 2004

(54) APPARATUS FOR PRODUCING A FIRE SPECIAL EFFECT USING STEAM

(75) Inventor: Rockne Hall, Newhall, CA (US)

(73) Assignee: Technifex, Inc., Valencia, CA (US)

( * ) Notice: Subject to any disclaimer, the term of this patent is extended or adjusted under 35 U.S.C. 154(b) by 0 days.

(21) Appl. No.: 10/063,264

(22) Filed: Apr. 4, 2002

(65) Prior Publication Data

US 2003/0190966 A1 Oct. 9, 2003

(51) Int. Cl.[7] ..... A63J 5/02
(52) U.S. Cl. ..... 472/65; 472/66; 40/427
(58) Field of Search ..... 472/61, 65, 66; 40/427, 428, 439, 440, 441

(56) References Cited

U.S. PATENT DOCUMENTS 643,493 A * 2/1900 Fuller ..... 472/65
3,334,816 A * 8/1967 Mizuno ..... 239/18
3,432,439 A * 3/1969 Dickman ..... 102/334
4,002,333 A * 1/1977 Gotoh ..... 472/65
4,026,544 A * 5/1977 Plambeck et al. ..... 472/64
4,426,021 A * 1/1984 Rosenthal ..... 222/129.1
5,407,392 A * 4/1995 Laijoki-Puska ..... 472/65
5,989,128 A 11/1999 Baker et al. ..... 472/65

FOREIGN PATENT DOCUMENTS

DE 3921407 A1 * 1/1991 ..... A63J/5/00

* cited by examiner

*Primary Examiner*—Kien T. Nguyen
(74) *Attorney, Agent, or Firm*—Holland & Hart LLP; Christopher J. Kulish, Esq.

(57) ABSTRACT

The present invention provides a device for producing a fire special effect using a steam curtain. In one embodiment, the device comprises a steam console for producing a curtain of steam/fog, an air modulator for providing a varying current of air that modulates the curtain of steam produced by the console, and a lighting assembly that produces a flood of colored light that is projected onto the modulated curtain of steam produced by the console and air modulator.

30 Claims, 9 Drawing Sheets

APPARATUS FOR PRODUCING A FIRE SPECIAL EFFECT USING STEAM

FIELD OF THE INVENTION

The present invention is directed to a special effect device and, in particular, to a device for producing a fire special effect using a steam curtain.

BACKGROUND OF THE INVENTION

The use of a simulated fire or flame is desirable in many applications. For instance, in many theme park attractions (e.g., volcano, battle scene and disaster scenes), the use of a simulated flame or fire is preferred relative to a real flame or fire for a number of reasons. To elaborate, a real flame or fire must typically be located a substantial distance from the audience to prevent members of the audience from getting burned. Further, with respect to attractions that are located indoors, a real flame or fire produces heat and smoke that typically require additional air conditioning and ventilation. In contrast, several types of simulated flame or fire effects can be located close to an audience and do not typically impose the air conditioning and ventilation requirements of a real flame or fire.

There are many types of devices for producing simulated flames or fire. For example, one type of device blows strips of colored material, such as silk, up into the air and shines an appropriately colored light onto the strips. From a distance, these devices provide a reasonably convincing simulated flame or fire. At the other end of the spectrum are devices that provide a television or video monitor with a signal of a pre-recorded fire or flame. Such devices are impractical in theme park applications that require a flame or fire that extends over a distance that is greater than the typical video monitor or television. Yet a further type of device involves the use of a screen of atomized water and the projection of an image or light on the screen that creates the illusion of a flame or fire.

SUMMARY OF THE INVENTION

The present invention is directed to a special effect device for producing a simulated flame or fire effect. In one embodiment, the special effect device comprises a console for producing a curtain of steam, which is probably more accurately characterized as a fog, adjacent to an outlet slot or port of a housing. The device further comprises an air modulator for producing a stream of air that is used to vary or modulate the curtain of steam produced by the console. The rising steam in the curtain of steam and the modulation of the curtain of steam closely mimics the dynamic action of an actual flame or fire. The special effect device further comprises lighting that directs a flood of appropriately colored light onto the modulated or undulating curtain of steam. The interaction of the flood of light with the moving curtain of steam yields a simulated flame or fire effect.

In one embodiment, the console comprises a steam manifold that contributes to the production of a curtain of steam with a substantially uniform or desired steam density. In one embodiment, the steam manifold has an elongated body with multiple output ports distributed along the length of the elongated body so that a curtain of steam is produced adjacent to the outlet slot for substantially the length of the console. The steam manifold further comprises an inlet port for receiving steam that is located between the ends of the elongated body. Locating the inlet port in this manner permits several such consoles to be placed end-to-end and, because each console is producing a curtain of steam for substantially the length of the console, a curtain of steam is produced over the extent of the consoles that has a uniform or desired steam density. In contrast, if consoles were utilized in which the steam manifold of one console had to be connected to the steam manifold of the next console by a coupler located between the consoles, there would likely be significant gaps between the curtains of steam produced by each console, thereby preventing a uniform or desired steam density from being achieved over the extent of the consoles. Further, even if a string of consoles could be coupled together so as to eliminate or substantially reduce any gaps in the resulting steam curtain, the ability to achieve a uniform or desired steam density over the extent of the string of consoles is facilitated by locating the inlet port for the steam manifold between the ends of the elongated body of the manifold. To elaborate, if the inlet port was not located between the ends of the elongated body of the manifold, a string of consoles would be coupled to one another and steam would be fed into the string of consoles from one or both of the consoles at the end of the string. In such a configuration, the pressure drop along the length of the string would have to be taken into account to achieve a uniform or desired steam density along the length of the string. This significantly complicates the design of a console, i.e., the need to take into account the effect of the other consoles in a string of consoles. In contrast, by placing an inlet port between the ends of the elongated body of the steam manifold, at least for consoles that are not the end consoles of a string, consoles can be independently designed to produce a uniform or desired steam density without having to take into account the effect of other consoles that are to be in a string of consoles.

In another embodiment, a steam manifold is provided that contributes to the production of a steam curtain with a substantially uniform or desired steam density. The manifold comprises an elongated hollow body with an inlet port for receiving steam and an outlet structure that extends over at least a portion of the length of the hollow body and allows steam to exit with a substantially uniform or desired density. In one embodiment, the outlet structure comprises holes in the elongated body of the manifold that are spaced from one another and/or of a size such that a profile of the resistance to steam exiting from the elongated body decreases with increasing distance from the inlet port. For example, if the inlet port is located at the mid-point of the elongated body, one possible outlet structure has two sets of holes extending in opposite directions from the mid-point of the elongated body with each set of holes having holes that are evenly spaced form one another, circular in shape, and increasing in diameter the further a hole is located from the inlet port.

Another embodiment of the special effect device includes a console for producing a relatively tall curtain of steam, which allows a fire of flame illusion to be produced over a broad range of heights. In one embodiment, the console comprises a housing with an outlet slot or port for venting the steam that produces the curtain or screen of steam. A steam manifold located within the housing employs an outlet structure that presents a relatively low resistance to the flow of steam. As a consequence, the outlet structure of the manifold contributes to the height of the curtain of steam produced adjacent to the outlet port of the housing when the special effect device is in operation. In one embodiment, the steam manifold comprises an elongated body and the outlet structure is a series of holes located between the ends of the elongated body. The holes present a relatively low resistance to the flow of steam when compared to fan nozzles. To elaborate, fan nozzles force any steam passing through the nozzle to traverse a 90 degree turn that reduces the velocity of the steam exiting the nozzle. This reduction in velocity means that the fan nozzle exhibits or is characterized by a relatively high resistance to the flow of steam. A hole or other outlet structure does not require the steam to make a 90 degree turn. Consequently, the steam exits the outlet port of the housing at a higher velocity.

In a further embodiment, the console comprises a housing with air entrainment holes that contribute to the density of the curtain of steam produced adjacent to the outlet slot of the housing during operation. By producing a denser curtain of steam, the visibility of the resulting fire effect is improved or enhanced. The air entrainment holes are located below the outlet structure of a steam manifold located within the housing. In one embodiment, the air entrainment holes are located as far below the outlet structure of the steam manifold as possible.

DETAILED DESCRIPTION

The present invention is directed to a special effect device that utilizes steam to produce a simulated flame or fire effect. Generally, the device includes a steam console for producing a curtain of steam that has a substantially constant or uniform steam density along at least a portion of the length of the console, an air modulator for modulating the curtain of steam produced by the console, and a lighting assembly for illuminating the curtain of steam produced by the console. In operation, illumination of the modulated curtain of steam produced by the console and the air modulator produces a simulated flame effect.

Figure 1:
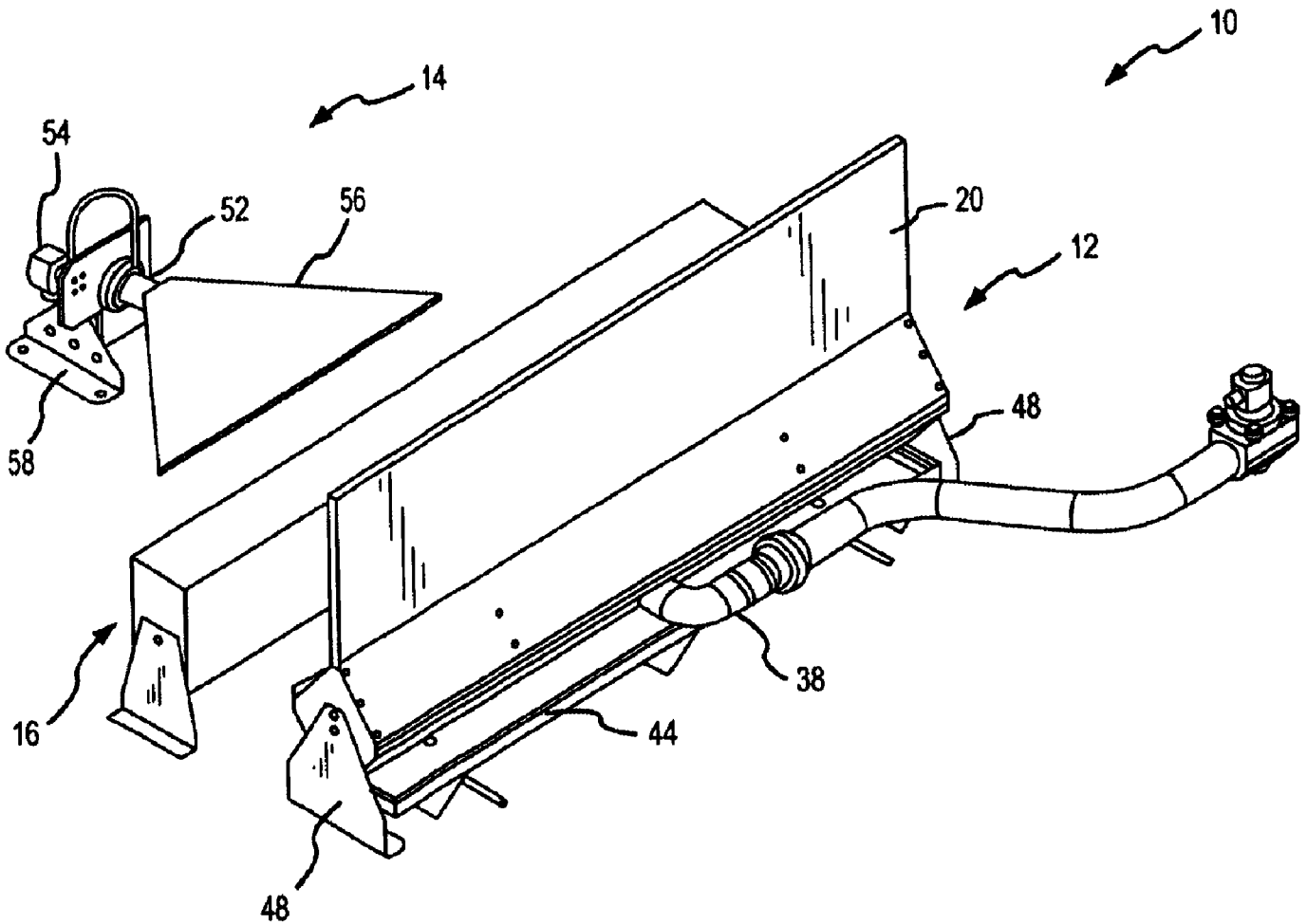
FIG. 1 illustrates an embodiment of a special effect device for producing a simulated flame or fire effect using a steam curtain.
Figure 2A:
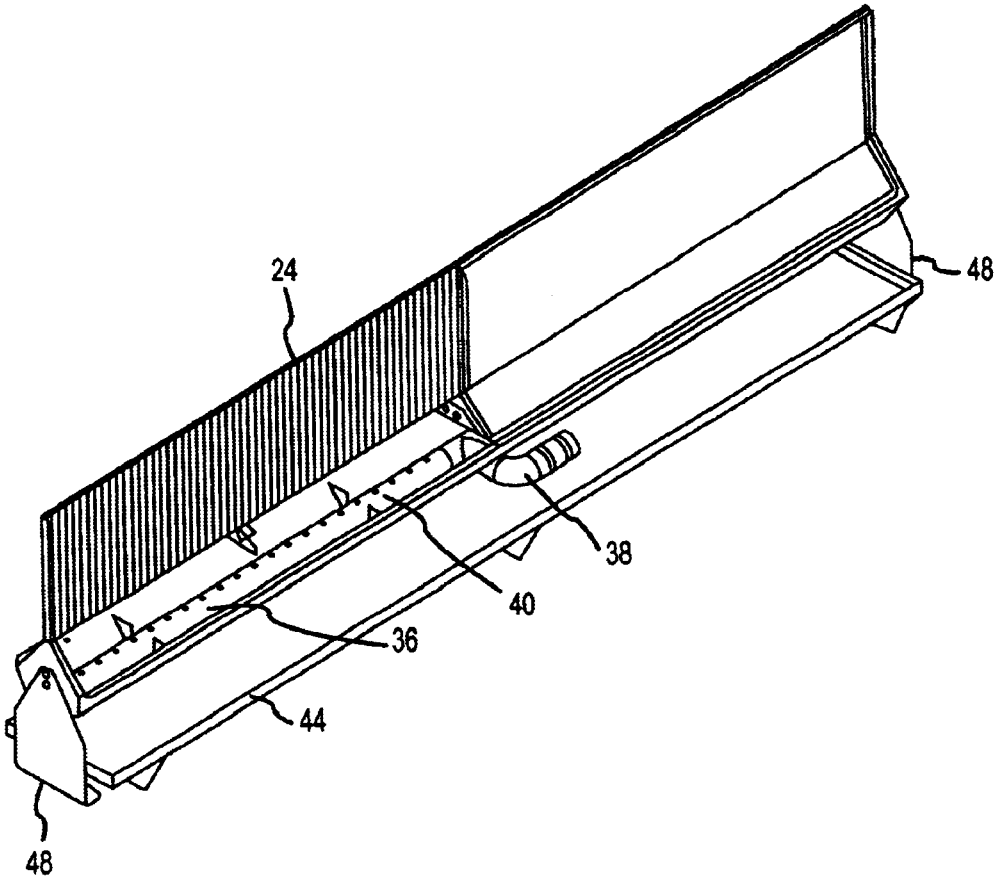
FIG. 2A is a cut away view of the steam console of the device shown in FIG. 1.
Figure 2B:
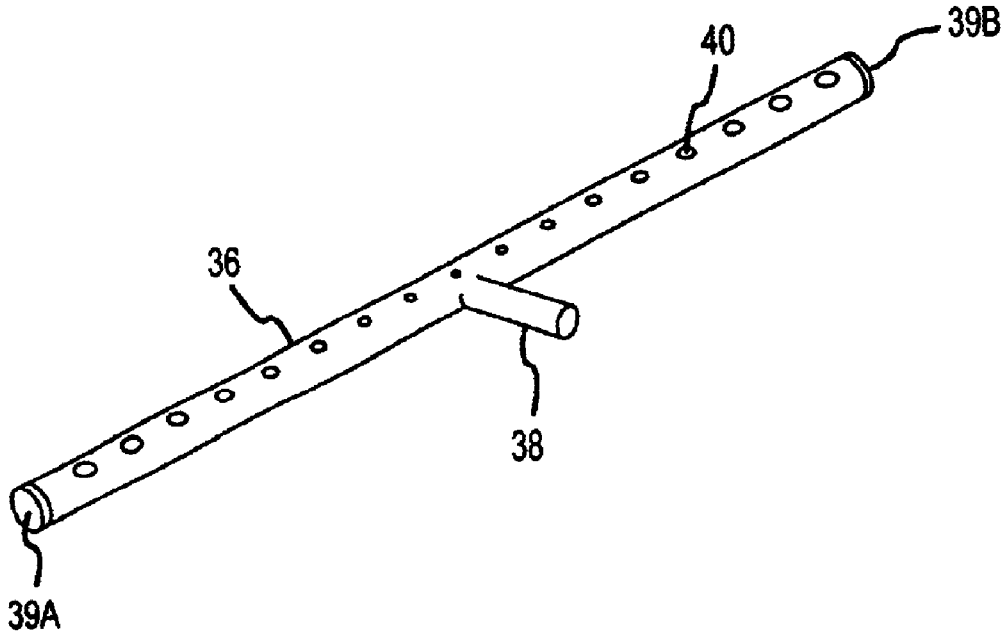
FIG. 2B is a perspective view of the steam emission manifold associated with the steam console of the device shown in FIG. 1.
Figure 3:
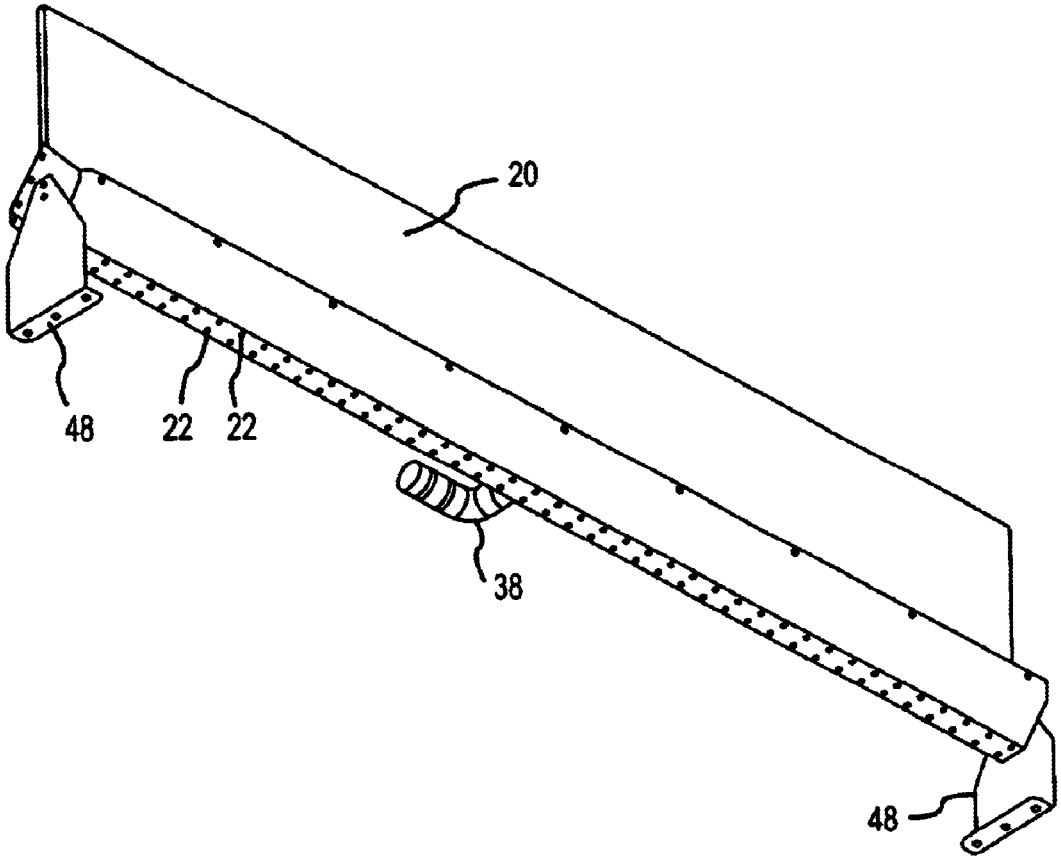
FIG. 3 is a bottom view of the steam console of the device shown in FIG. 1.
Figure 4:
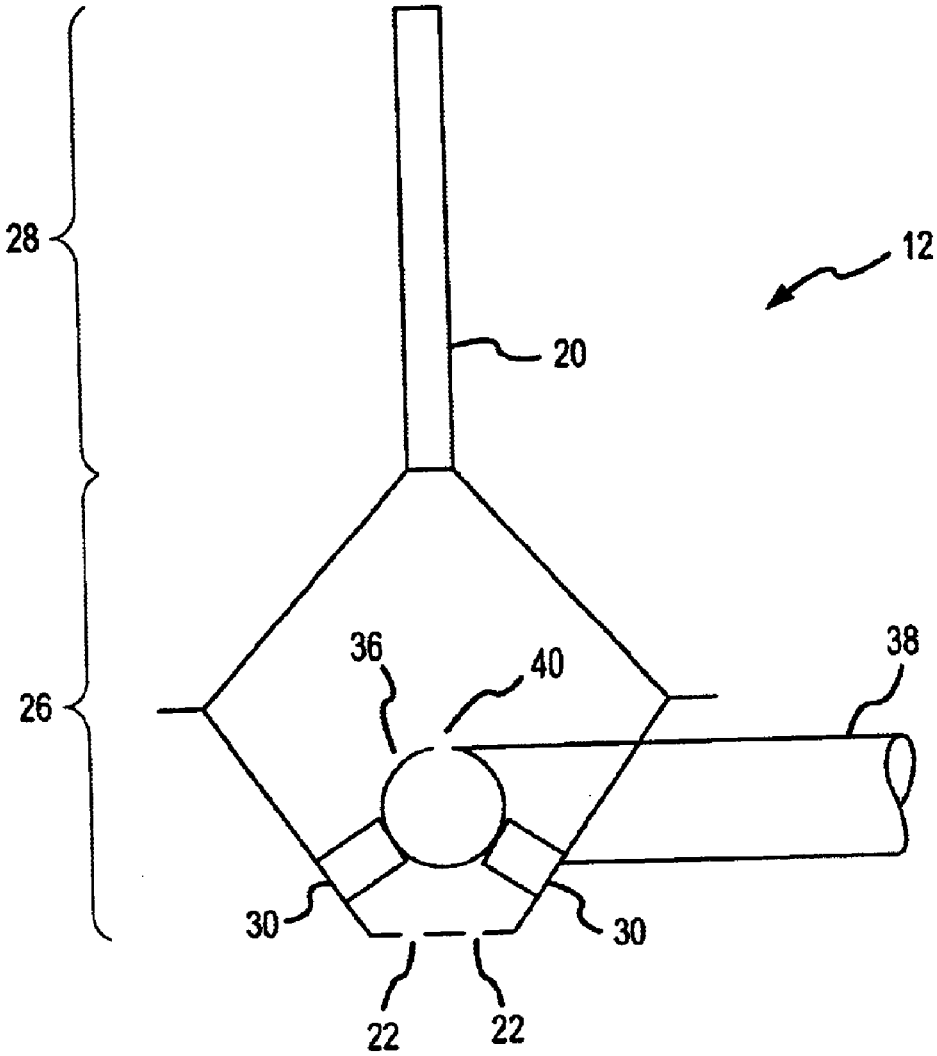
FIG. 4 is a cross-sectional view of the steam console shown in FIG. 1.

FIG. 1 illustrates an embodiment of the special effect device, which is hereinafter referred to as device 10, that uses steam to produce a simulated flame or fire effect. The device 10 comprises a steam console 12 for producing a curtain of steam of substantially uniform steam density along at least a portion of the length of the console, an air modulator 14 for modulating the curtain of steam of that is produced by the console 12, and a lighting assembly 16 for illuminating the modulated curtain of steam produced by the console 12 and air modulator 14 to achieve the simulated flame effect.

With reference to FIGS. 1–4, the steam console 12 comprises housing 20 for holding a steam emission manifold 22 and a flow straightener 24. The housing 20 defines a manifold portion 26 for holding the steam emission manifold 22 and an outlet slot portion 28 for holding the flow straightener 24. Both the manifold portion 26 and the outlet slot portion 28 extend for substantially the length of the console 12. In the illustrated embodiment, the width of the outlet slot portion 28 is ½" to ¾". However, the width can be varied if required by a particular application. The manifold portion 22 comprises several pairs of braces 30 for supporting the steam emission manifold 22. In addition, the manifold portion 22 has a number of air entrainment holes 32 that, during operation, allow air to enter the housing 20 and cool the steam being vented from the steam emission manifold to facilitate the production of the steam curtain adjacent to the outlet slot portion 28.

The steam emission manifold 22 comprises an elongated tube 36 that extends for substantially the entire length of the housing, an inlet port 38 for receiving steam produced by a boiler (not shown) and providing the received steam to the elongated tube 36, and a pair of end caps 39A, 39B that define the ends of the tube 36. The elongated tube 36 has a plurality of holes 40 for allowing steam to vent such that there is a substantially uniform distribution of steam along the length of the tube 36. The substantially uniform distribution of steam is achieved by spacing and/or sizing the holes such that the profile of the resistance of the holes to the flow of steam decreases as the distance from the inlet port 38 increases. In the illustrated embodiment, the distance between adjacent holes is substantially constant. However, the size or diameter of the holes increases with increasing distance from the inlet port 38. In an alternative embodiment, the size or diameter of each of the holes is substantially the same, but the distance between adjacent holes decreases with increasing distance from the inlet port 38. In yet a further embodiment, both the distance between adjacent holes and the size/diameter of the holes vary with the distance from the inlet port 38. The spacing and size of the holes can also be tailored to facilitate the production of a steam curtain with varying steam density (e.g., greater steam density in the middle of the console and lesser density at the ends of the console).

The holes 40 facilitate the production of a tall steam curtain adjacent to the outlet slot portion 28 of the housing. To elaborate, in an embodiment of a steam emission manifold that uses a nozzle instead of a hole, the structure of the nozzle typically requires the steam to change direction between the elongated tube and the exit port of the nozzle. In the case of a fan nozzle, the steam typically has to travel around a 90 degree bend in passing between the elongated tube and the exit port of such a nozzle. Such changes in direction reduce the velocity of the steam being vented from the steam emission manifold and, as a consequence, reduce the height of the steam curtain produced adjacent to the outlet slot portion of the housing. In contrast, a hole does not require the steam to change direction and, therefore, facilitates the production of a tall curtain of steam.

The elongated tube 36 is oriented in the housing 20 such that the plurality of holes 40 lie along a substantially straight line that lies substantially in a plane defined by the outlet slot portion 28. This orientation of the holes 40 relative to the outlet slot portion 28 also facilitates the production of a tall curtain of steam. To elaborate, in an embodiment in which the venting structure associated with the steam emission manifold does not vent the steam in the plane defined by the outlet slot portion, the steam is required to change directions between the vent and the outlet slot portion. This change indirection reduces the velocity of the steam and, relatedly, the height of the curtain of steam produced adjacent to the outlet slot portion 28. In contrast by locating the holes 40 substantially directly under the outlet slot portion 28, the steam venting from the holes 40 follows a substantially straight path between the holes 40 and the outlet slot portion 28. Consequently, the steam does not have to change direction and the velocity of the steam exiting the outlet portion 28 is greater than it would be if the steam had to change direction. This greater velocity, in turn, facilitates the production of a tall curtain of steam.

Figure 5A:
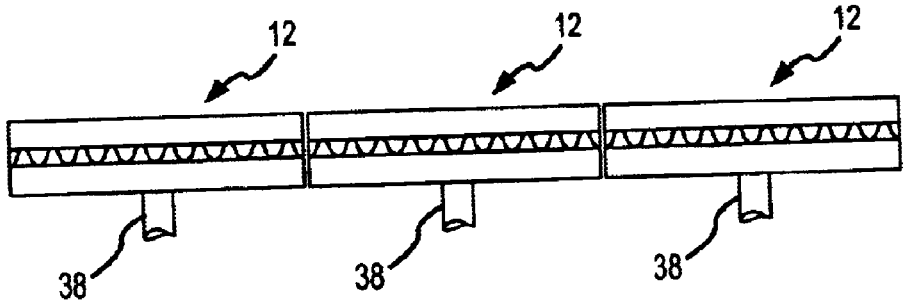
FIGS. 5A–5C respectively illustrate a series of consoles of the type shown in FIG. 1 located end-to-end, a console of the type shown in FIG. 1 located end-to-end with a console having an inlet port situated at the end of the console, and a console of the type shown in FIG. 1 located end-to-end with consoles that each have an inlet port situated at the end of the console.
Figure 5B:
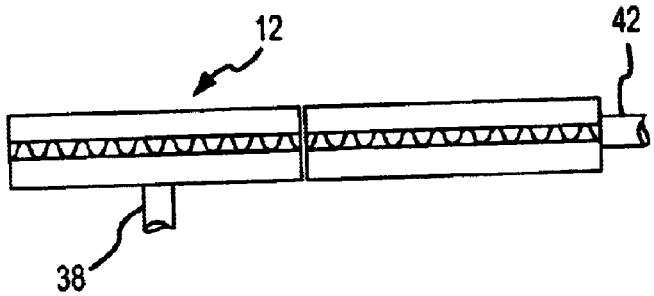
Figure 5C:
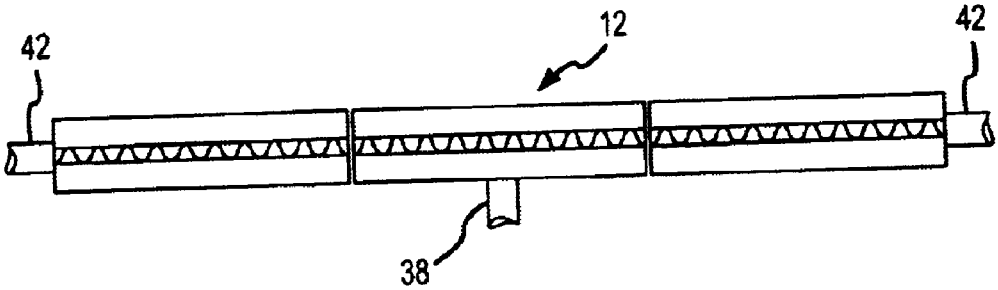

The inlet port 28 is located between the ends of the elongated tube 36. In the illustrated embodiment, the inlet port 28 is located at substantially the mid-point between the ends of the tube 36. By locating the inlet port 28 between the ends of the tube 36, the console 12 can be placed end-to-end with one or more consoles with similarly located inlet ports to achieve a substantially continuous simulated flame or fire effect over the length of the consoles, as shown in FIG. 5A. Alternatively, the console 12 is placed end-to-end with a console that has an inlet port 42 located at one end of its steam emission manifold to achieve a substantially continuous simulated flame effect over the length of the two consoles, as shown in FIG. 5B. In yet another alternative, the console 12 is placed end-to-end with two consoles that each have an inlet port 42 located at one end of a steam emission manifold to achieve a simulated flame or fire effect over the length of three consoles, as shown in FIG. 5C. The inlet port 28 can be placed at locations between the ends of the tube 36 other than the mid-point and still provide the ability to place the console 12 end-to-end with other consoles. Generally, however, if a steam curtain is to be produced along the length of the console 12, the location of the inlet port 28 is chosen so as not to interfere with the venting of steam from the tube 36. Further, it should be appreciated that the location of the inlet port 28 impacts the distribution and/or sizing of the holes 40 if a uniform steam density or varied steam density profile is desired. In addition, it should also be appreciate that by placing the inlet port 28 between the ends of the elongated tube 36, the design of a fire special effect that requires a string of consoles is significantly simplified. To elaborate, by locating the inlet port 28 between the ends of the elongated tube 36, a uniform or desired steam density for the console 12 can be designed without having to take into account the effect of other consoles in a string of consoles.

Figure 6A:
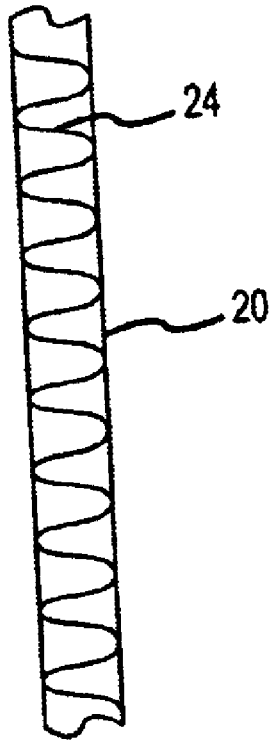
FIG. 6 illustrates two possible types of flow straighteners for use in the steam console shown in FIG. 1.
Figure 6B:
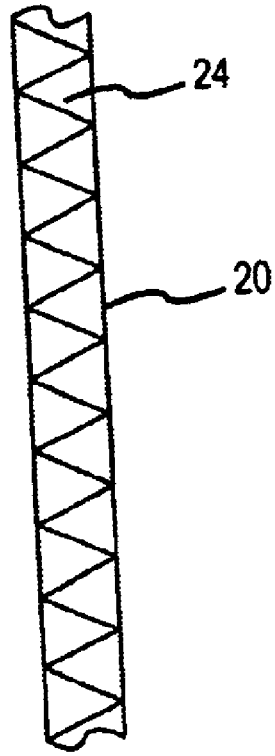

The flow straightener 24, absent the application of the air modulator 14, facilitates the production of a relatively smooth curtain of steam, i.e., the steam adjacent to the outlet slot portion 28 flows substantially directly upward. The flow straightener 24 also strives to reduce condensation that, in turn, reduces the amount of steam available to produce the curtain of steam. To elaborate, a flow straightener in the form of "honeycomb" (hexagonal cells) has a relatively high surface area that promotes condensation and, as a consequence, reduces the steam available to produce the curtain of steam. By utilizing a flow straightener with less surface area relative to a "honeycomb" flow straightener, condensation is reduced. Two possible configuration for the flow straightener 24 that have less surface area than a hexagonal flow straightener are the sinusoidal or triangular configuration respectively shown in FIGS. 6A and 6B. Other configurations are also feasible. The flow straightener 24 is preferably made of stainless steel, which has been found to be easier to clean and capable of withstanding the heat of the steam. However, other materials, such as plastic and fiberglass, are also feasible.

The steam console 12 further comprises condensate collection tray 44 for collecting water that condenses within the housing 20 and flows out the air entrainment holes 32 of the housing. In certain applications, the condensate collection tray 44 is not needed. For example, if the housing 20 is located on a floor or substrate that is capable of draining water, the condensate collection tray 44 may not be necessary.

The steam console 12 also comprises a pair of brackets 48 for attaching the housing 20 to a floor, substrate or frame.

The air modulator 14 produces a varying sheet-like current of moving air that is directed at the curtain of steam produced by the steam console 12. The air modulator 14 is comprised of a fan 52 (e.g., blower, squirrel-cage blower, shaded pole blowers etc.), an electromechanical device 52 for modulating the stream of air produced by the fan 52, and a fan nozzle for distributing the modulated air substantially across the extent of the outlet slot portion 28. A bracket assembly 58 facilitates attachment of the air modulator 14 to a floor, substrate or frame. In the illustrate embodiment, the electromechanical device 52 is a device that rotates a disk with one or more holes in front of the intake of the fan 54 to facilitate the production of the varying current of moving air. Other for varying the flow of air on the intake or output side of the fan 52 or similar device are feasible. As an alternative to the fan 52, a compressed air driven "air amplifier" or air amplified blower/exhausters, such as those made by Coppus and Exair, can be used to produce the current of moving air.

Figure 7:
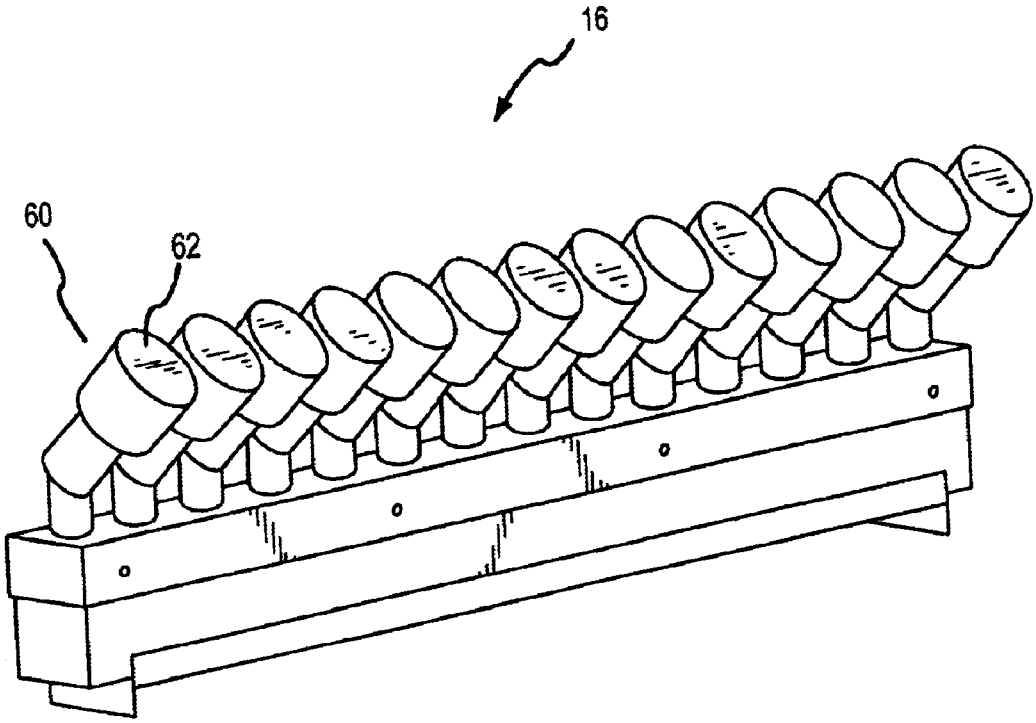
FIG. 7 illustrates the lighting assembly employed in the embodiment of the device shown in FIG. 1.

With reference to FIG. 7, the lighting assembly 16 produces the light that is directed to the modulated curtain of steam produced by the steam console 12 and air modulator 14 to produce the flame or fire special effect. The lighting assembly 16 is comprised of a lights 60 with each light having a colored filter 62. Each of the color filters is typically a combination of red, orange, yellow and sometimes blue color filters that are pieced together in a manner that when light is shown through them the colors of a flame are produced in a naturally occurring sequence, (e.g. red at the bottom, followed by orange, and yellow at the top). Flicker devices are used to modulate the intensity of the lights 60. In one embodiment, there is a flicker device associated with each of the lights 60 so that the lights to not flicker in synchronism but rather flicker in a quasi-random manner.

Other lighting structures are also feasible. For example, a lighting structure that employs different colored lights is feasible. Further, any lighting assembly is capable of being adapted to facilitate the production of flame or fire images of colors other than the previously noted red, orange, yellow and blue colors. For example, a lighting assembly can be adapted for the production of a flame or fire image in which the image is comprised of various shades of green. Yet another possible lighting structure is a projector that, during operation, projects a video image of a fire onto the screen.

Figure 8A:
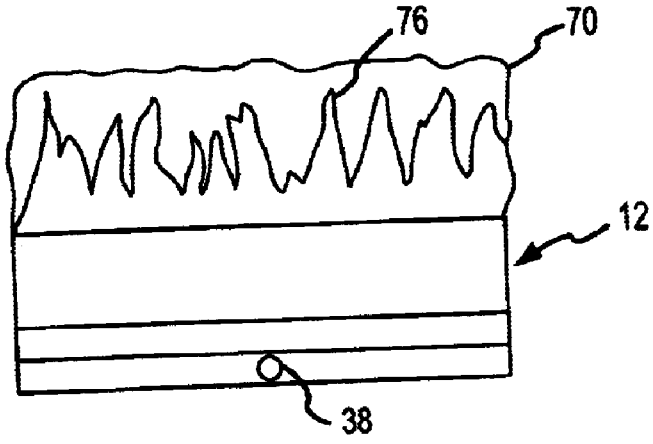
FIGS. 8A–8C respectively are rear, side and top views of the device shown in FIG. 1.
Figure 8B:
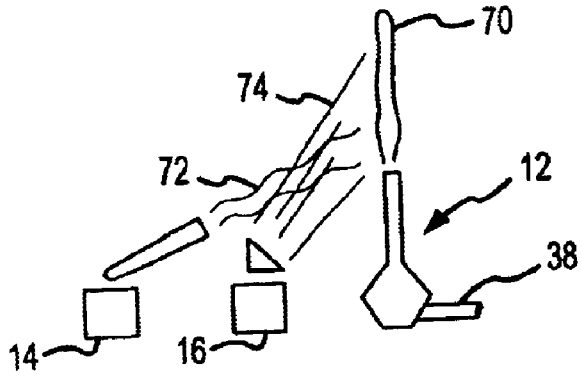
Figure 8C:
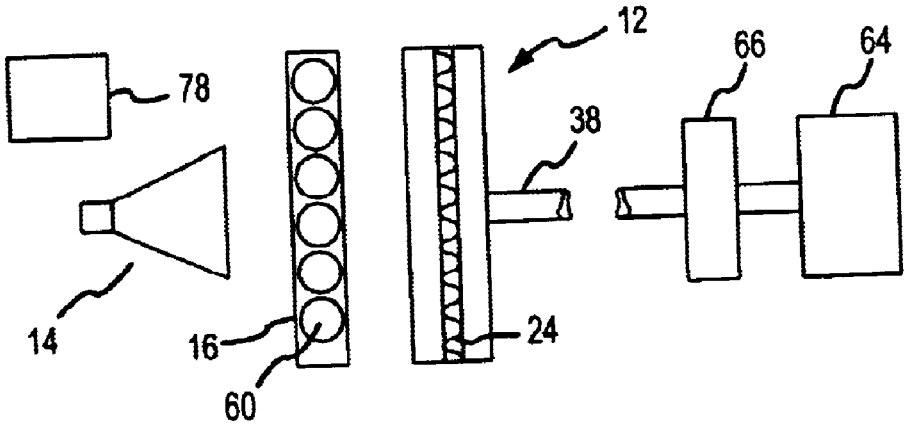
Figure 1:
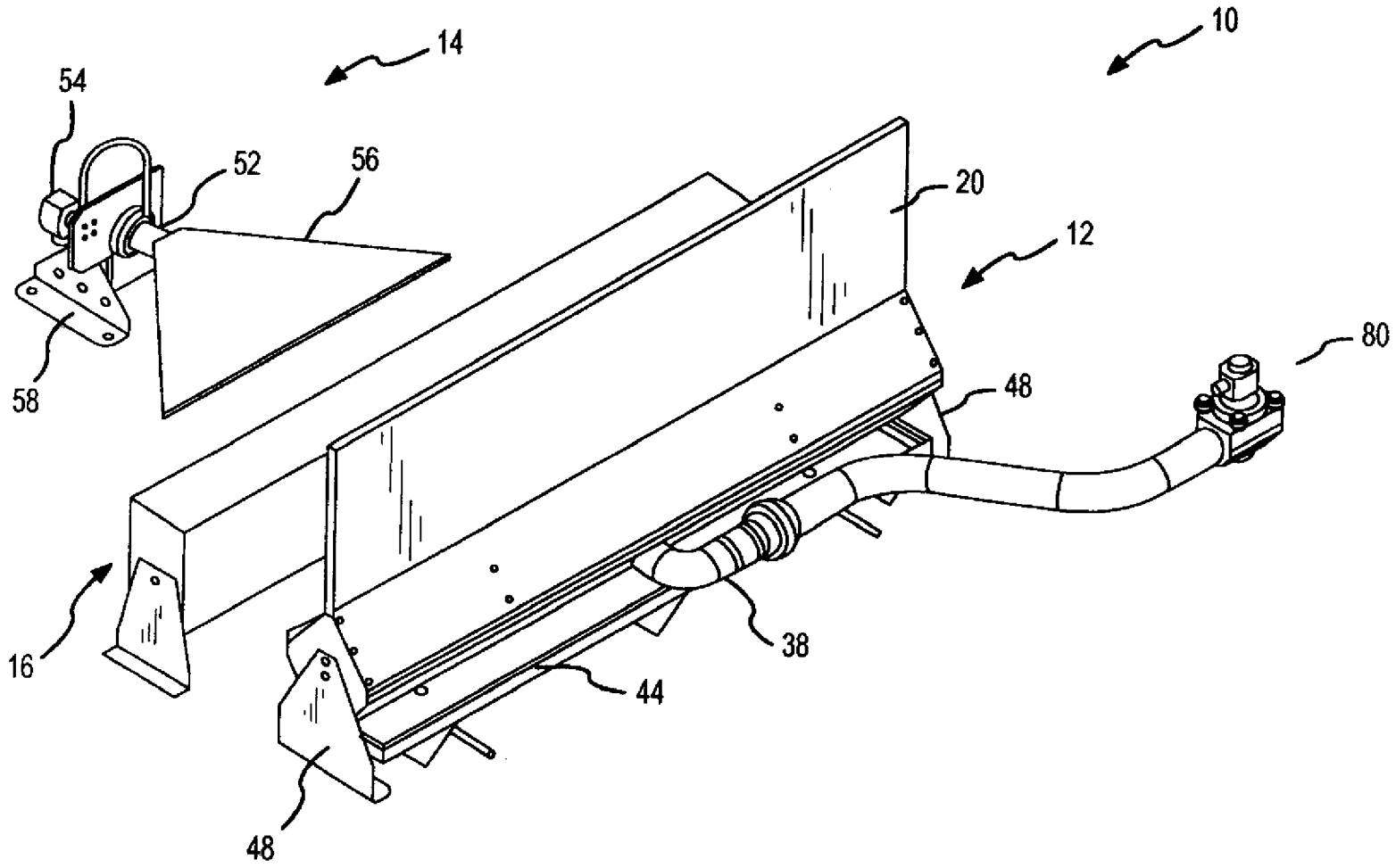
Figure 2B:
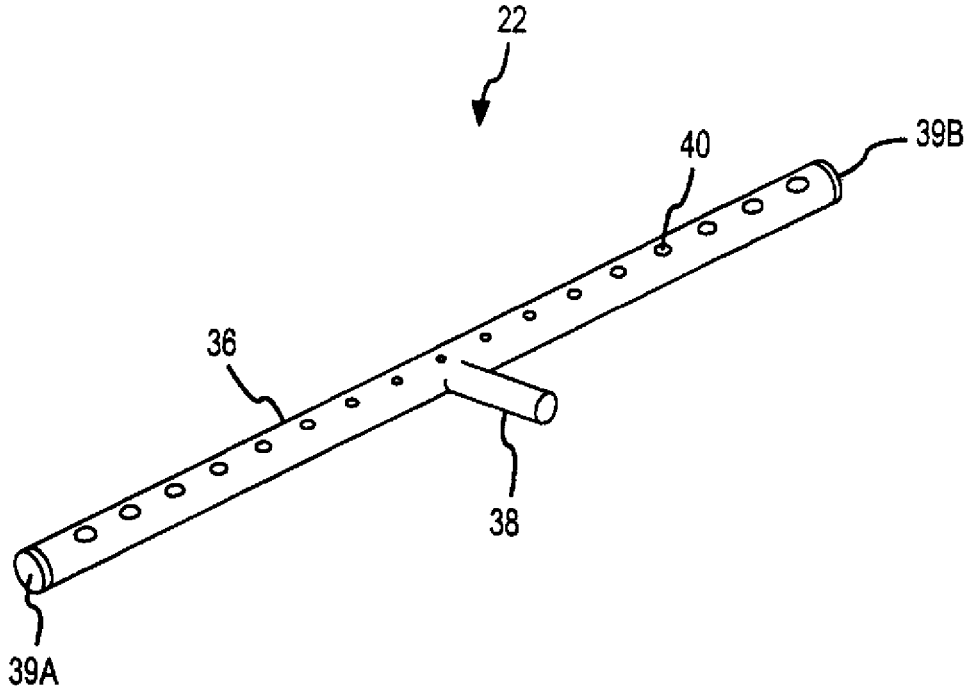
Figure 3:
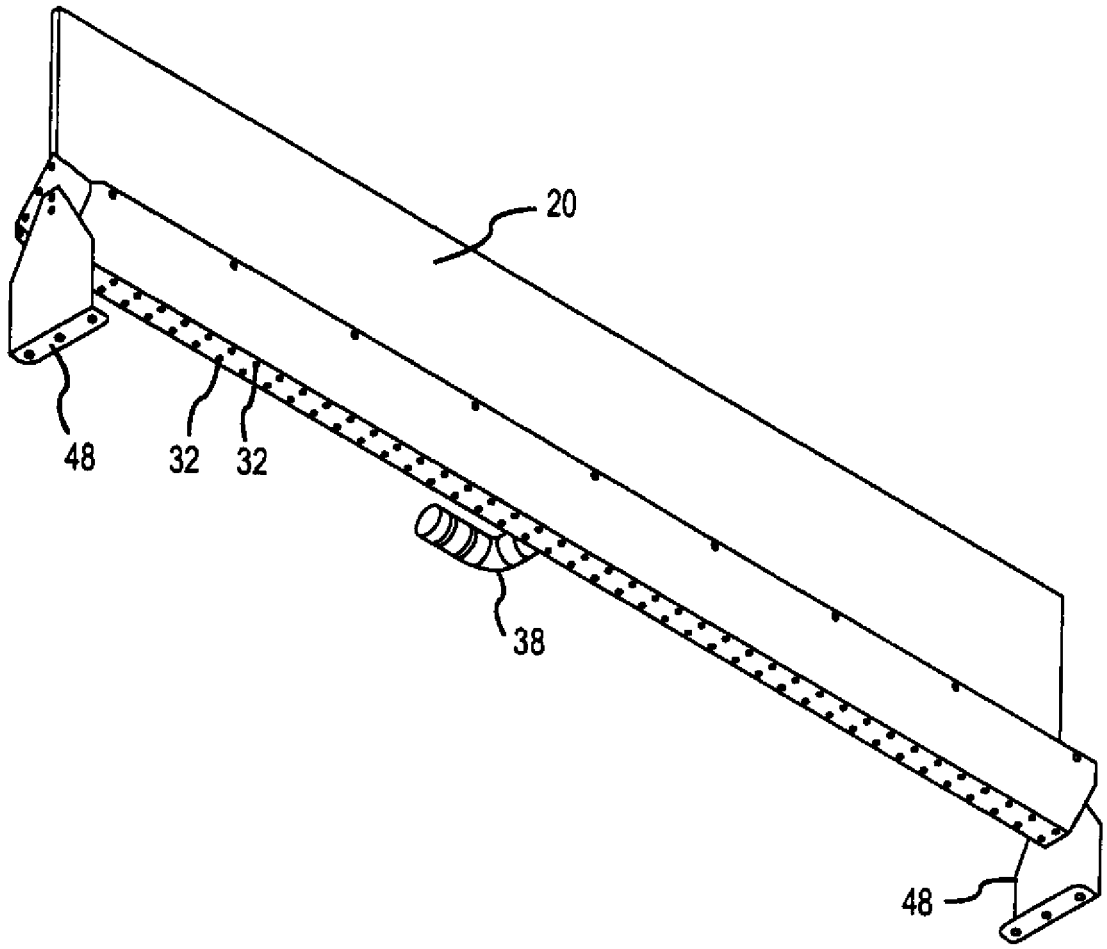
Figure 4:
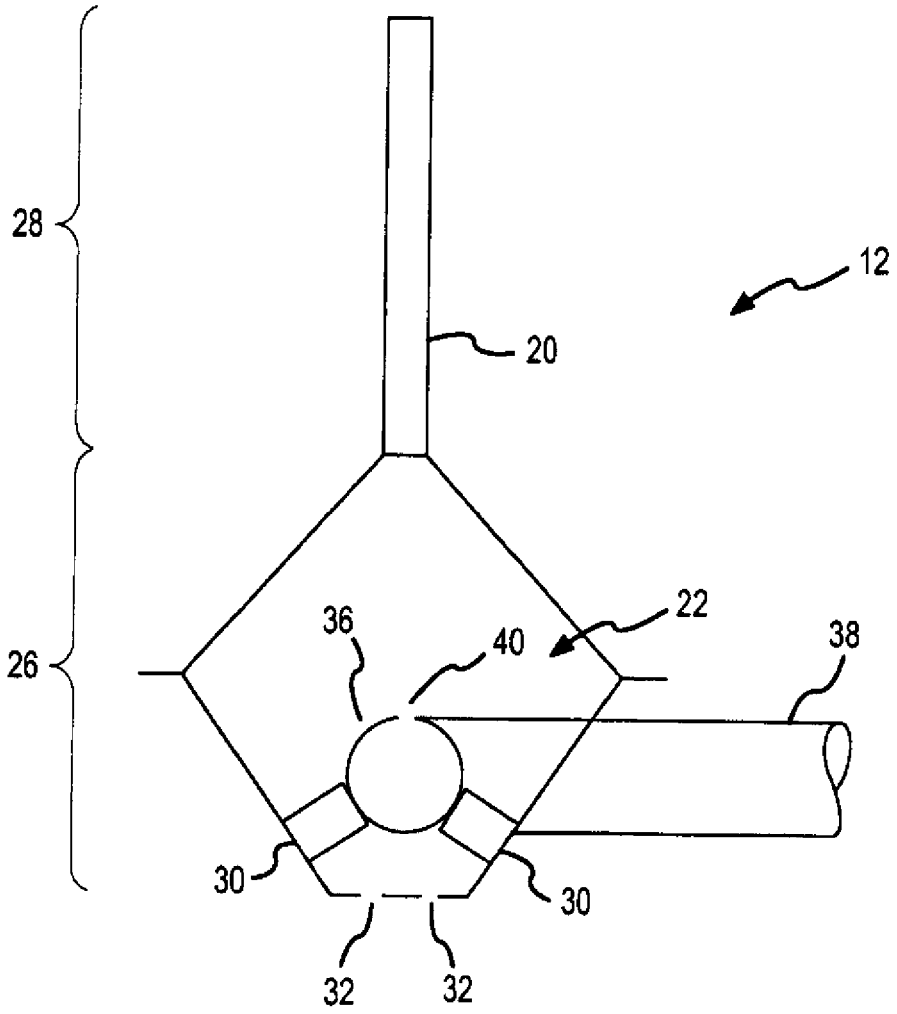

With reference to FIGS. 8A–8C, the operation of the device 10 is described. A boiler 64 produces the steam that is used by the console 12 to produce a steam curtain. Typically, the pressure of the steam produced by the boiler 64 is 2–5 psi. However, the device 10 can be adapted to operate at other pressure ranges, if needed. A main manifold 66 serves to output the steam produced by the boiler 64 to one or more of the consoles 12 at substantially equal and desired pressures for operation of the consoles 12. Provided the steam lines between the main manifold 66 and each of the consoles present substantially equal thermodynamic losses, the consoles 12 each receive steam at substantially the same pressure and temperature. In the embodiment illustrated in FIGS. 8A–8C, since there is only one console 12, the main manifold 66 could be eliminated if the boiler 64 is susceptible to appropriate regulation.

In any event, the steam produced by the boiler 64 is received at the inlet port 38 of the console 12 and distributed along the length of the elongated tube 36. The steam is vented from the tube 36 via the holes 40 such that there is substantially even distribution of steam along the length of the tube 36. The steam venting from the holes 40 mixes with the relatively cooler air that is entering the manifold portion 26 of the housing 20 by the air entrainment holes 32. The mixing of the steam with the cooler air promotes condensation and the densification of the resulting "steam" curtain produced adjacent to the outlet slot portion 28. After mixing with the cooler air, the steam passes through the flow straightener 24 and exits the console adjacent to the outlet slot portion 28. Absent the operation of the air modulator 14, a steam/fog curtain 70 is produced adjacent to the outlet slot portion 28.

The mixing of the steam vented from the tube 36 with the cooler air and flow straightener 24 promote condensation that results in some of the steam being converted to water droplets that are too massive to be ejected from the outlet slot portion 28 of the housing 20. Many of these water droplets drain through the air entrainment holes 32 and are collected in the condensation tray 44.

The air modulator 14 produces a varying current of air 72 that modulates the curtain of steam/fog produced by the console 12 in a manner that closely simulates the action of a flame or fire.

The lighting assembly 16 produces a flood of light 74 that interacts with the modulated steam/fog curtain produced by the operation of the console 12 and the air modulator 14 to produce a simulated flame or fire effect 76.

A control and electrical power distribution system 78 distributes power to the air modulator 14 and the lighting assembly 16. The system 78 also includes the electronic circuitry for causing the lights of the lighting assembly to flicker or change in intensity. Further, the system 78 controls a solenoid 80 (FIG. 1) that permits a user to selectively or controllably apply steam from the boiler 64 to the console 12. The ability to control the application of steam to the console 12 also impacts the height of the resulting curtain of steam, i.e., the greater the pressure of the steam applied to the console 12, the greater the height of the resulting curtain of steam produced adjacent to the outlet slot portion 28.

A number of modifications to the device 10, in addition to any already noted, are feasible. For instance, the air entrainment holes 32 could be eliminated and a steam/fog curtain produced. However, without the pre-cooling of the air that enters through the holes 32, the cooling of the steam would primarily occur after the steam was vented from the outlet slot portion 28. As a consequence, the steam/fog curtain would form further from the outlet slot portion 28 than it would otherwise, which maybe undesirable in certain applications. The relative positions of the console 12, air modulator 14 and lighting assembly16 can be changed from those shown in the drawings to address particular applications of the device 10. Further, while many of the elements of the console 12 are linear in nature, curved elements are also feasible. For example, a curved tube can replace the tube 36. Further, the holes along such a curved tube for venting the steam can be positioned to lie in a curved plane that is defined by a curved outlet slot portion that houses a curved flow straightener. Another possible modification is to use a slot rather than the holes 40 to achieve the desired profile for resistance to the flow of steam.

The embodiments of the invention described hereinabove are intended to describe the best mode known of practicing the invention and to enable others skilled in the art to utilize the invention.

What is claimed is:

1. A special effect device that utilizes steam to create a simulated fire effect comprising:

first means for generating a steam curtain along a line that extends from a first location to a second location and has a substantially uniform steam density;

second means for modulating the position of a steam curtain produced by said first means to produce a modulated steam curtain that simulates the action of a fire; and third means for lighting a modulated steam curtain produced by said first and second means to produce a simulated fire effect.

2. A special effect device, as claimed in claim 1, wherein:

said first means comprises a steam emission manifold having a first terminal end, second terminal end, and an inlet port located between said first and second terminal ends.

3. A special effect device, as claimed in claim 2, wherein:

said steam emission manifold further comprises a plurality of outlet ports with said plurality of outlet ports presenting a profile for resistance to the flow of steam that decreases with increasing distance from said inlet port.

4. A special effect device, as claimed in claim 1, wherein:

said first means comprises a steam emission manifold having a first terminal end, second terminal end, a steam inlet port, and a plurality of outlet ports with said plurality of outlet ports presenting a profile for resistance to the flow of steam that decreases with increasing distance from said inlet port.

5. A special effect device, as claimed in claim 4, wherein:

said steam inlet port is located between said first and second terminal ends.

6. A special effect device that utilizes steam to create a simulated fire effect comprising:

a housing that defines an outlet slot and an interior volume;

a steam emission manifold substantially located within said interior volume and comprising an elongated hollow body having a first terminal end and a second terminal end, an inlet port for providing steam to an interior space of said elongated hollow body and that is located between said first and second terminal ends of said elongated hollow body, and an outlet structure for venting steam from said interior space of said elongated hollow body and located between said first and second terminal ends of said elongated hollow body;

an air modulator for producing a flow of air for altering the position of a steam curtain produced adjacent to said outlet slot; and a lighting system for projecting light onto a modulated steam curtain produced adjacent to said outlet slot.

7. A special effect device, as claimed in claim 6, wherein:

said inlet port is located along a midsection of said elongated hollow body.

8. A special effect device, as claimed in claim 6, wherein:

said inlet port is located at substantially a midpoint between said first and second terminal ends of said elongated hollow body.

9. A special effect device, as claimed in claim 6, wherein:

said outlet structure adapted to produce a desired steam density profile; and said inlet port is located to substantially avoid interfering with the production of said desired steam density profile by said outlet structure.

10. A special effect device, as claimed in claim 6, wherein:

said outlet structure presenting a profile for resistance to the flow of steam that decreases with increasing distance from said inlet port.

11. A special effect device, as claimed in claim 6, wherein:

said housing having a plurality of air entrainment holes that lie along a first line;

said plurality of outlet ports lie along a second line; and said first and second lines lie in a plane defined by said outlet slot.

12. A special effect device, as claimed in claim 6, further comprising:

a corrugated flow straightener located within said outlet slot of said housing.

13. A special effect device, as claimed in claim 6, wherein:

said outlet structure comprises a plurality of holes.

14. A special effect device, as claimed in claim 6, wherein:

said outlet structure comprises a plurality of nozzles.

15. A special effect device, as claimed in claim 6, wherein:

said outlet structure comprises a slot.

16. A special effect device that utilizes steam to create a simulated fire effect comprising:

a housing that defines an outlet slot and an interior volume;

a steam emission manifold substantially located within said interior volume and comprising an elongated hollow body having a first end and a second end, an inlet port for providing steam to said elongated body, and a plurality of outlet ports with said plurality of outlet ports presenting a desired profile for resistance to the flow of steam;

an air modulator for producing a flow of air for altering the position of a steam curtain produced adjacent to said outlet port; and a lighting system for projecting light onto a steam curtain produced adjacent to said outlet port.

17. A special effect device, as claimed in claim 16, wherein:

said plurality of outlet ports comprises a first outlet port with a first hole having a first diameter and located a first distance from said inlet port and a second outlet port with a second hole having a second diameter and located a second distance from said inlet port;

said second diameter being greater than said first diameter; and said second distance being greater than said first distance.

18. A special effect device, as claimed in claim 16, wherein:

said plurality of outlet ports comprising a first outlet port and a second outlet port;

wherein said first outlet port is located a first distance from said inlet port;

wherein said second outlet port is located a second distance from said first outlet port; and wherein said second distance is less than said first distance.

19. A special effect device, as claimed in claim 16, wherein:

said plurality of outlet ports define a line.

20. A special effect device, as claimed in claim 19, wherein:

said plurality of outlet ports and said outlet slot lie in a plane defined by said outlet slot.

21. A special effect device, as claimed in claim 20, wherein:

said plane is one of the following: a flat plane and a curved plane.

22. A special effect device, as claimed in claim 16, further comprising:

air entrainment holes extending through said housing and located below said outlet ports of said steam emission manifold.

23. A special effect device, as claimed in claim 22, wherein:

said air entrainment holes and said outlet slot lie in a plane defined by said outlet slot.

24. A special effect device, as claimed in claim 23, wherein:

said plane is one of the following: a flat plane and a curved plane.

25. A special effect device, as claimed in claim 16, further comprising:

a flow straightener located within said outlet slot.

26. A special effect device, as claimed in claim 25, wherein:

said flow straightener having a surface area that is less than the surface area of a hexagonal flow straightener.

27. A special effect device, as claimed in claim 26, wherein:

said flow straightener is a corrugated flow straightener.

28. A special effect device, as claimed in claim 16, wherein:

said inlet port coincides with said first end.

29. A special effect device, as claimed in claim 16, wherein:

said inlet port is located between said first and second ends.

30. A special effect device that utilizes steam in creating a simulated fire effect comprising:

a housing defining an outlet slot that further defines an outlet volume, an interior volume, and a plurality of entrainment holes extending through said housing;

a flow straightener located within said outlet volume;

a steam emission manifold substantially located within said interior volume and comprising an elongated hollow body having a first terminal end, a second terminal end, an inlet port for providing steam to an interior of said elongated body and that is located between said first and second terminal ends, and a plurality of outlet ports with said plurality of outlet ports presenting a desired profile for resistance to the flow of steam the greater the distance from said inlet port;

wherein said plurality of outlet ports, flow straightener, and said air entrainment holes reside substantially in a plane;

an air modulator for producing a flow of air for altering the position of a steam curtain produced adjacent to said outlet port; and a lighting system for projecting light onto a steam curtain produced adjacent to said outlet port.

* * * * *

UNITED STATES PATENT AND TRADEMARK OFFICE

CERTIFICATE OF CORRECTION

PATENT NO. : 6,685,574 B2
APPLICATION NO. : 10/063264
DATED : February 3, 2004
INVENTOR(S) : Hall It is certified that error appears in the above-identified patent and that said Letters Patent is hereby corrected as shown below:

The Title Page, showing an illustrative figure, should be deleted and substitute therefor the attached Title Page;
Delete drawing sheet 1, consisting of FIG. 1, and replace with drawing sheet 1, consisting of FIG. 1 (attached);
Delete drawing sheet 3, consisting of FIG. 2B, and replace with drawing sheet 3, consisting of FIG. 2B (attached);
Delete drawing sheet 4, consisting of FIG. 3, and replace with drawing sheet 4, consisting of FIG. 3 (attached);
and
Delete drawing sheet 5, consisting of FIG. 4, and replace with drawing sheet 5, consisting of FIG. 4 (attached);
Column 1, line 17, delete “located a substantial”; and insert --located at a substantial--;
Column 2, line 48, delete “spaced form one”; and insert --spaced from one--;
Column 4, line 9, delete “portion 22 has”; and insert --portion 26 has--;
Column 5, line 6, delete “inlet port 28 is”; and insert --inlet port 38 is--;
Column 5, line 8, delete “port 28 is”; and insert --port 38 is--;
Column 5, line 9, delete “inlet port 28 between”; and insert --inlet port 38 between--;
Column 5, line 23, delete “28 can be”; and insert --38 can be--;
Column 5, line 28, delete “port 28 is”; and insert --port 38 is--;
Column 5, line 30, delete “inlet port 28 impacts”; and insert --inlet port 38 impacts--;
Column 5, line 33, delete “be appreciate that”; and insert --be appreciated that--;
Column 5, line 33, delete “inlet port 28”; and insert --inlet port 38--;
Column 5, line 36, delete “inlet port 28”; and insert --inlet port 38--;
Column 5, line 62, delete “comprises condensate”; and insert --comprises a condensate--;
Column 6, line 5, delete “device 52”; and insert --device 54--;
Column 6, line 7, delete “fan nozzle for”; and insert --fan nozzle 56 for--;
Column 6, line 11, delete “device 52 is”; and insert --device 54 is--;
Column 6, line 12, delete “fan 54”; and insert --fan 52--;

UNITED STATES PATENT AND TRADEMARK OFFICE

CERTIFICATE OF CORRECTION

PATENT NO. : 6,685,574 B2
APPLICATION NO. : 10/063264
DATED : February 3, 2004
INVENTOR(S) : Hall It is certified that error appears in the above-identified patent and that said Letters Patent is hereby corrected as shown below:

Column 6, line 14, delete “Other for”; and insert --Other devices for--.

Signed and Sealed this

Nineteenth Day of May, 2009

JOHN DOLL
*Acting Director of the United States Patent and Trademark Office*

(12) United States Patent
Hall

(10) Patent No.: US 6,685,574 B2
(45) Date of Patent: Feb. 3, 2004

(54) APPARATUS FOR PRODUCING A FIRE SPECIAL EFFECT USING STEAM

(75) Inventor: Rockne Hall, Newhall, CA (US)

(73) Assignee: Technifex, Inc., Valencia, CA (US)

( * ) Notice: Subject to any disclaimer, the term of this patent is extended or adjusted under 35 U.S.C. 154(b) by 0 days.

(21) Appl. No.: 10/063,264

(22) Filed: Apr. 4, 2002

(65) Prior Publication Data

US 2003/0190966 A1 Oct. 9, 2003

(51) Int. Cl.[7] ..... A63J 5/02
(52) U.S. Cl. ..... 472/65; 472/66; 40/427
(58) Field of Search ..... 472/61, 65, 66; 40/427, 428, 439, 440, 441

(56) References Cited

U.S. PATENT DOCUMENTS

| | | | | | |
|---|---|---|---|---|---|
| 643,493 | A | * | 2/1900 | Fuller | 472/65 |
| 3,334,816 | A | * | 8/1967 | Mizuno | 239/18 |
| 3,432,439 | A | * | 3/1969 | Dickman | 102/334 |
| 4,002,333 | A | * | 1/1977 | Gotoh | 472/65 |
| 4,026,544 | A | * | 5/1977 | Plambeck et al. | 472/64 |
| 4,426,021 | A | * | 1/1984 | Rosenthal | 222/129.1 |
| 5,407,392 | A | * | 4/1995 | Laijoki-Puska | 472/65 |
| 5,989,128 | A | | 11/1999 | Baker et al. | 472/65 |

FOREIGN PATENT DOCUMENTS

| | | | | |
|---|---|---|---|---|
| DE | 3921407 A1 | * | 1/1991 | A63J/5/00 |

* cited by examiner

*Primary Examiner*—Kien T. Nguyen
(74) *Attorney, Agent, or Firm*—Holland & Hart LLP; Christopher J. Kulish, Esq.

(57) ABSTRACT

The present invention provides a device for producing a fire special effect using a steam curtain. In one embodiment, the device comprises a steam console for producing a curtain of steam/fog, an air modulator for providing a varying current of air that modulates the curtain of steam produced by the console, and a lighting assembly that produces a flood of colored light that is projected onto the modulated curtain of steam produced by the console and air modulator.

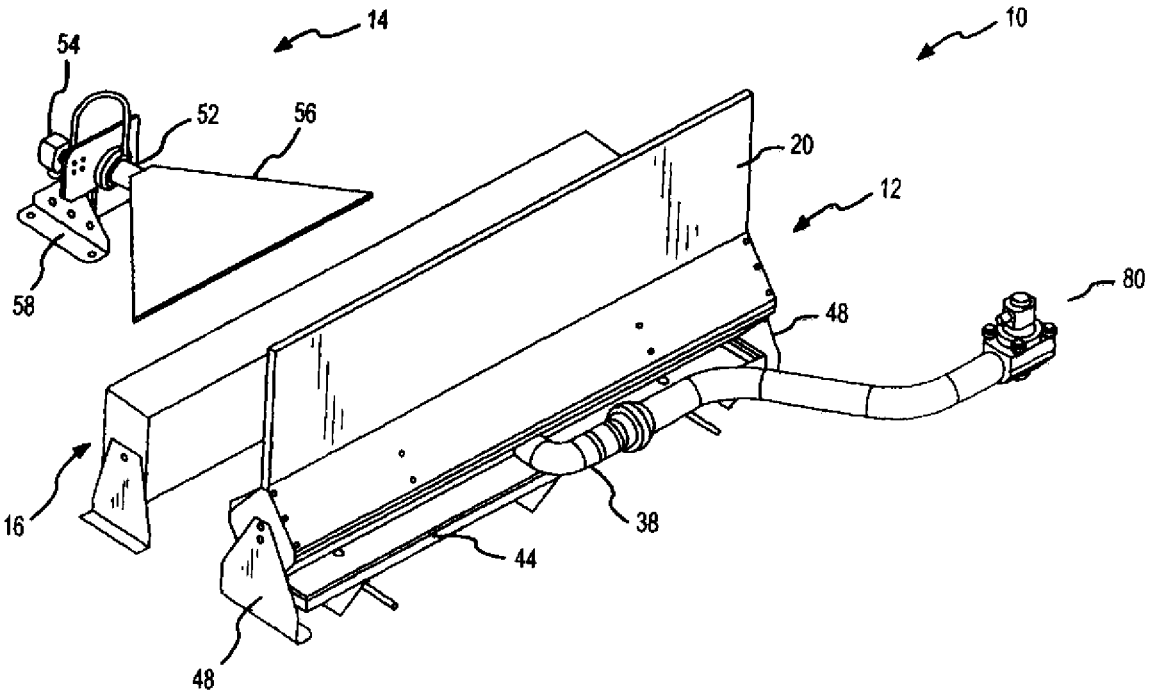

30 Claims, 9 Drawing Sheets